US005192149A

United States Patent [19]

Gillio

[11] Patent Number: 5,192,149

[45] Date of Patent: Mar. 9, 1993

[54] CASSETTE FOR TYPING RIBBON FOR TYPEWRITERS

[75] Inventor: Claudio Gillio, Brosso Canavese, Italy

[73] Assignee: Ing. C. Olivetti & C., S.p.A., Ivrea, Italy

[21] Appl. No.: 606,946

[22] Filed: Oct. 31, 1990

[30] Foreign Application Priority Data

Dec. 21, 1989 [IT] Italy ..... 68145 A/89

[51] Int. Cl.[5] ..... B41J 33/14

[52] U.S. Cl. ..... 400/208; 400/234; 400/236; 400/242

[58] Field of Search ..... 400/242, 234, 697.1, 400/208, 208.1, 212, 213, 236

[56] References Cited

U.S. PATENT DOCUMENTS

| | | | |
|---|---|---|---|
| 3,863,749 | 2/1975 | Perry et al. | 400/213 |
| 4,427,313 | 1/1984 | Giolitti | 400/697.1 |
| 4,710,047 | 12/1987 | Barouh et al. | 400/242 |
| 4,780,011 | 10/1988 | Hasegawa et al. | 400/234 |
| 5,007,749 | 4/1991 | Falconieri et al. | 400/234 |

*Primary Examiner*—Edgar S. Burr
*Assistant Examiner*—John S. Hilten
*Attorney, Agent, or Firm*—Banner, Birch, McKie & Beckett

[57] ABSTRACT

A unitary cassette for a typewriter comprises a container and two arms. The container comprises two support elements and which project from the bottom and which are capable of rotatably supporting a supply spool and a take-up spool for a correction ribbon. Two guide elements projecting from the ends of the arms guide a portion of the ribbon below the typing ribbon, and a tensioning device holds the ribbon taut. The cassette can be mounted on a carriage of the machine by means of two projections projecting from the underneath of the bottom and which are capable of being pivotally mounted in two respective grooves and moving against two co-operating surfaces for oscillating movement about an axis parallel to the roller. A pin on one side of the container can be removably engaged into a seat of a connecting lever of the machine, which is connected to a displacement means.

18 Claims, 5 Drawing Sheets

CASSETTE FOR TYPING RIBBON FOR TYPEWRITERS

BACKGROUND OF THE INVENTION

The present invention relates to a cassette for a typing ribbon for typing machines, e.g. typewriters, comprising a container capable of accommodating a typing ribbon and having two projecting arms for positioning an external portion of the typing ribbon in front of a platen roller of the machine and coupling means for coupling at the underside a correction device for forming a unitary typing and correction cassette, and wherein the correction device comprises a correction ribbon, a supply spool onto which the correction ribbon is wound and a take-up spool onto which said correction ribbon is re-wound after having been used.

European patent application No. 0 014 763 discloses a typing cassette of that type, to which a container for a correction ribbon can be coupled in such a way as to form a unitary typing and correction cassette which can then be removably fitted to the machine. That cassette is reliable and functional for being mounted on typewriters of standard type, but it is excessively expensive and bulky to be fitted to portable typewriters in which both cost and size must be reduced to the maximum extent.

SUMMARY OF THE INVENTION

The invention is defined in the appended claims to which reference should be made.

In a preferred embodiment of the invention described in more detail below, a cassette for a typing ribbon is provided with two support elements for rotatably supporting the supply spool and the take-up spool respectively, and two guide elements which project downwardly from the ends of the two arms of the container to guide a portion of the correction ribbon below the external portion of the typing ribbon.

The preferred cassette additionally comprises projections projecting downwardly from the container and which define two pivot mounting elements and two counteracting elements. The two projections are capable of being inserted between two grooves and two stop members of the machine in such a way that the pivot mounting elements are pivotally disposed in said grooves to permit the container to oscillate about an axis of oscillation movement which is parallel to the platen roller. The container further comprises a laterally and outwardly projecting connecting element adjacent to one of the arms and capable of being engaged by a seat of a connecting lever of a displacement means of the machine. Finally the counteracting elements of the cassette are capable of being acted against by the stop members of the machine for positive control of an oscillating travel movement of the container which is determined by the connecting lever.

The preferred embodiment provides a cassette for a typing ribbon which is simple, reliable, and easy to use, and in particular is of very moderate cost and size.

BRIEF DESCRIPTION OF THE DRAWINGS

The preferred embodiment of the invention is set forth in the following description by way of non-limiting example and with reference to the accompanying drawings in which.

DETAILED DESCRIPTION OF THE PREFERRED EMBODIMENT

Figure 1:
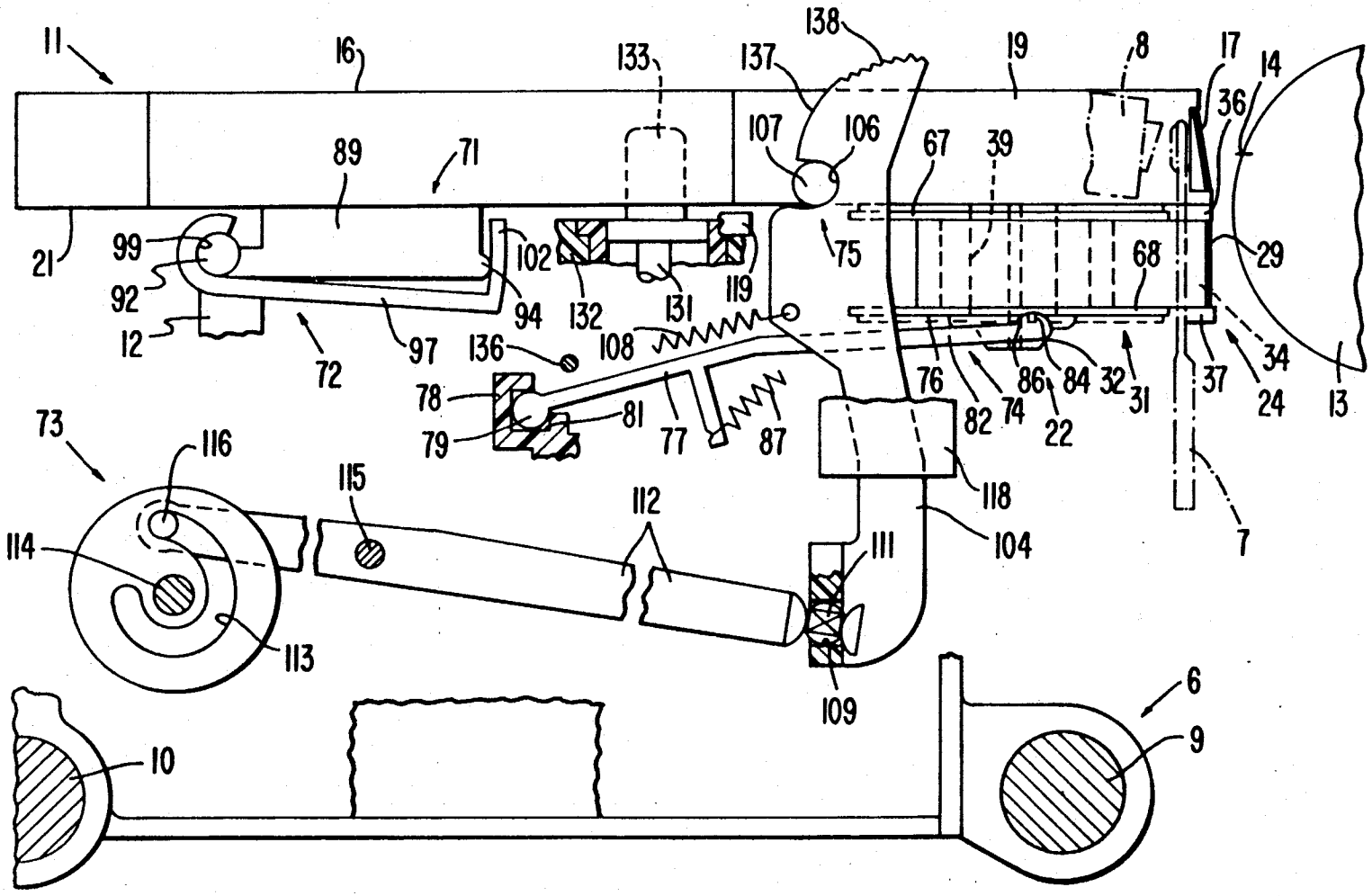
FIG. 1 is a longitudinal view of part of a typewriter on which a cassette embodying the invention is fitted.
Figure 2:
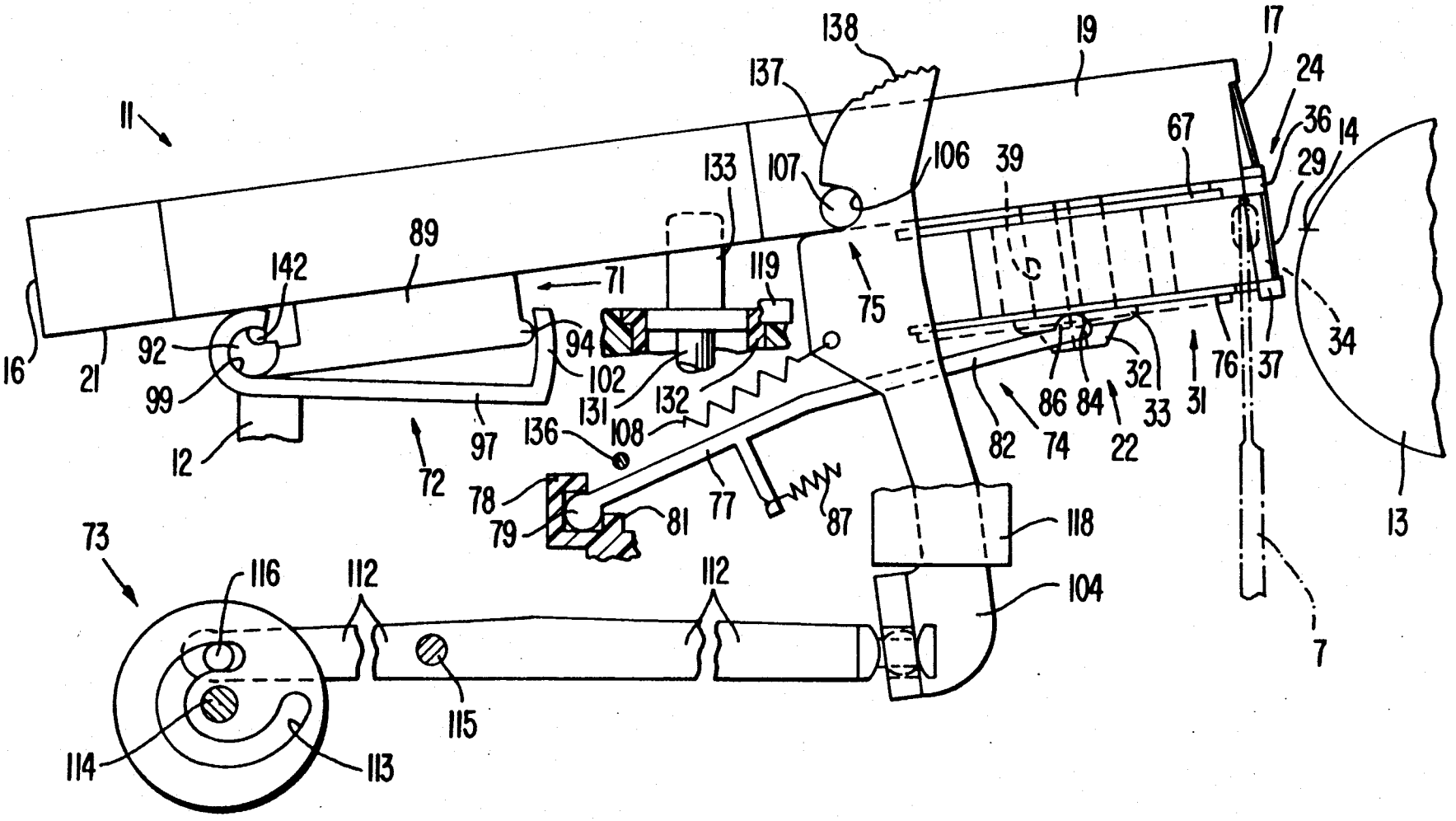
FIG. 2 is a longitudinal view of part of the cassette in FIG. 1 in an operating position.
Figure 3:
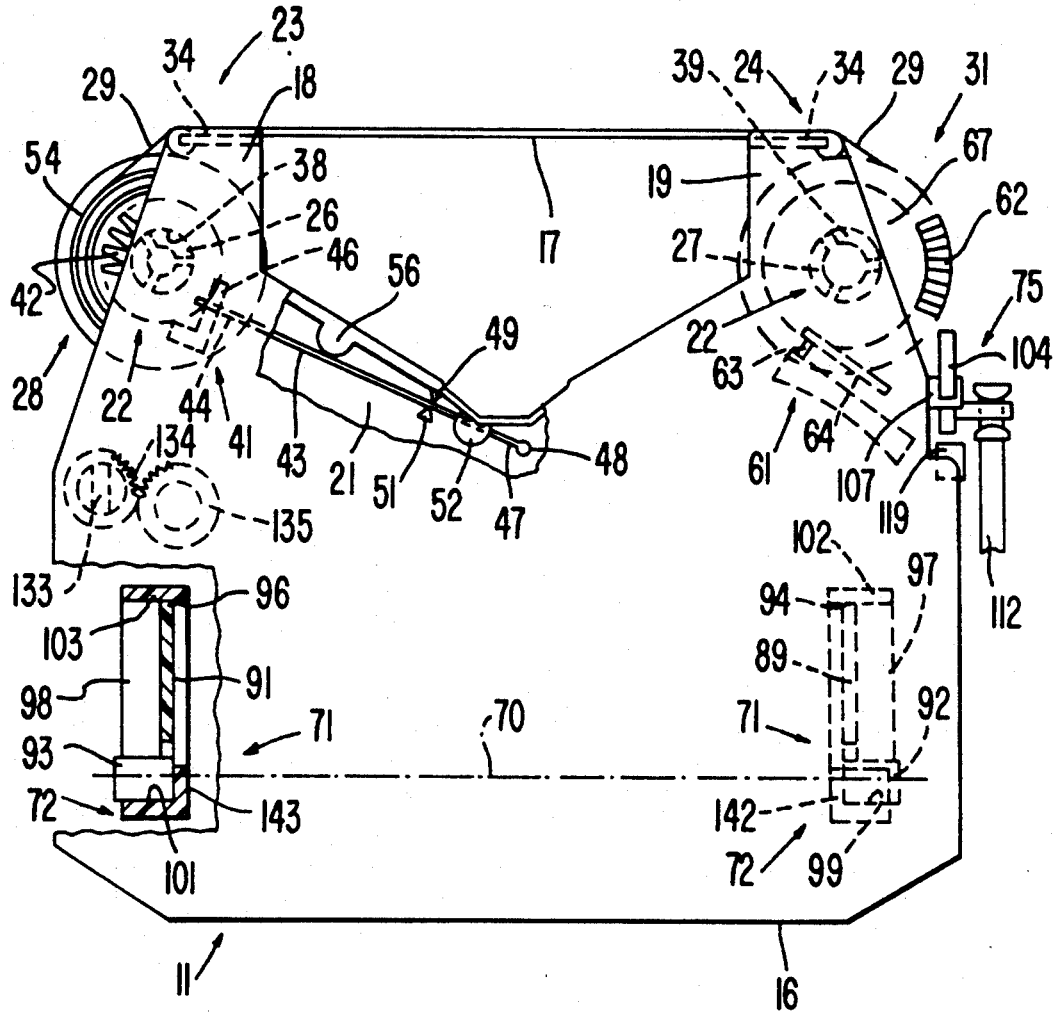
FIG. 3 is a plan view of part of the cassette shown in FIG. 1 on a different scale from FIG. 1.
Figure 6:
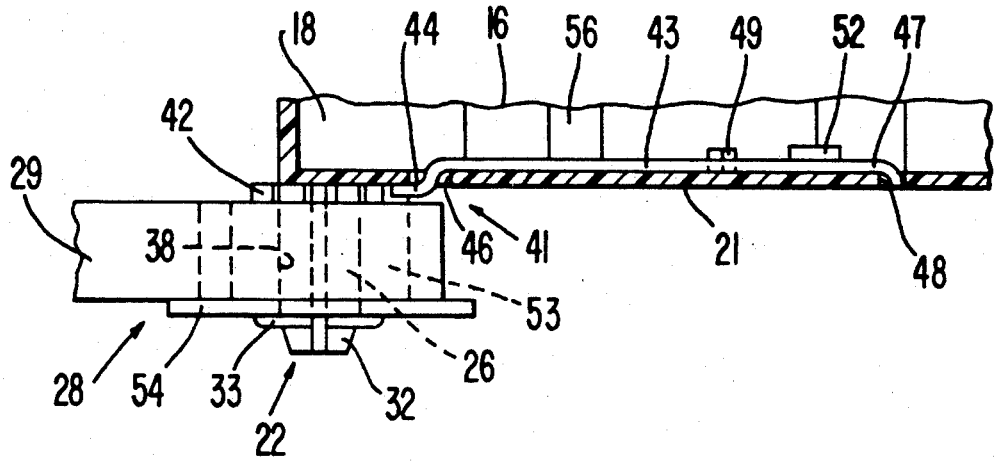
FIG. 6 is a view in partial section in some details from FIG. 3 on a different scale.
Figure 4:
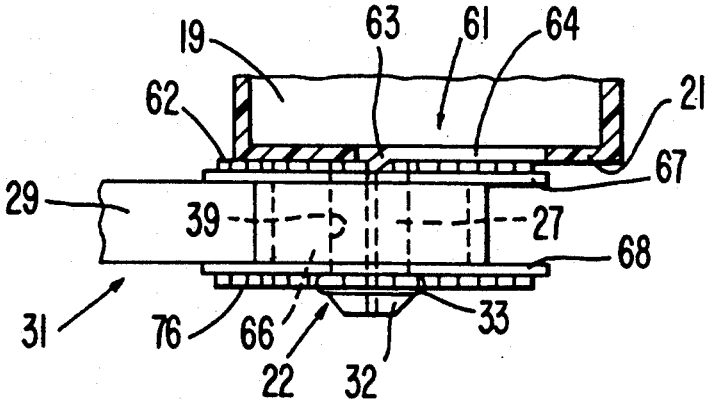
FIG. 4 is a view in partial section of some details from FIG. 3 on a different scale.
Figure 5:
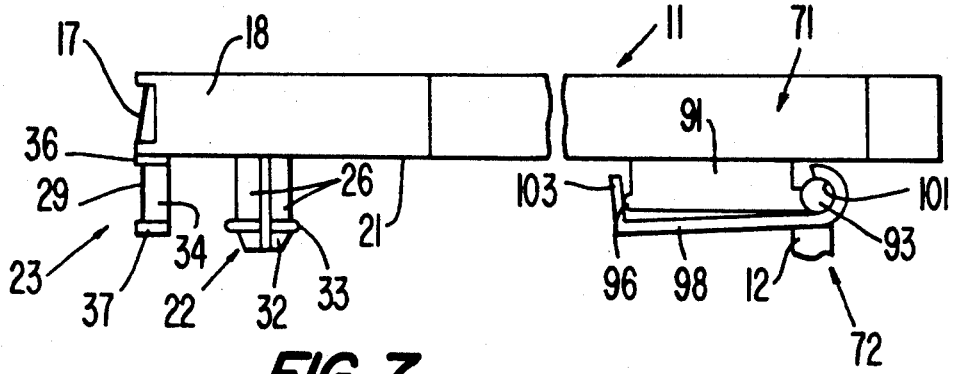
FIG. 5 is a longitudinal view of part of the cassette shown in FIG. 3.

Referring to FIGS. 1, 2 and 3 the cassette for a typing ribbon as generally indicated at reference numeral 11 is removably mounted and fixed on a support 12 of a typewriter comprising a normal platen roller 13 which defines a typing point 14, a carriage 6, a character carrying disc 7 and a striker hammer 8. The carriage 6 is movable and slidable along two guides 9 and 10 back and forth parallel to the platen roller 13 and is capable of supporting the support 12 in known fashion. The carriage 6, the disc 7 and the striker hammer 8 are known per se and are only illustrated diagrammatically and are not described in detail herein in order not to complicate the description and the drawings.

The cassette 11 comprises a container 16 capable of accommodating a typing ribbon 17 and having two projecting arms 18 and 19 for positioning an external portion of the typing ribbon 17 in front of the typing point 14. The container 16 has a bottom 21 from which coupling means indicated generally by reference numeral 22 and two guide elements 23 and 24 project downwardly and outwardly.

The coupling means (FIGS. 1, 2, 3, 4, 5 and 6) are fixed with respect to the bottom 21 and comprise two support elements 26 and 27 of which the first is capable of rotatably supporting a supply spool 28 on which a correction ribbon 29 is wound and the second is capable of rotatably supporting a take-up spool 31 on which the correction ribbon 29 is rewound after having been used. Each of the two support elements 26, 27 comprises a main cylindrical body which is subdivided into three resilient segments which are disposed at 120° relative to each other for co-operating with a cylindrical seat 38, 39 in the respective spool 28, 31. The three resilient segments of the elements 26, 27 are radially flexible and each has at its free end a bevel portion 32 for assisting fitting of the central core 53, 56 of the respective spool 28, 31 and a shoulder 33 which is adjacent to the bevel portion 32 but which projects radially to prevent accidental disengagement of the respective spool 28, 31 from the three resilient segments of the elements 26, 27.

The two guide elements 23 and 24 are fixed with respect to the bottom 21 and each comprise a suitably shaped central plate portion 34 having at its ends two shoulders 36 and 37 capable of preventing vertical displacement of the correction ribbon 29. The two guide elements 23 and 24 are parallel to the two support elements 26 and 27 and are positioned at the ends of the arms 18 and 19 of the container 16 for guiding a portion of correction ribbon 29 below the external portion of the typing ribbon 17, in parallel relationship to the platen roller 13. In particular the correction ribbon 29 is unwound from the supply spool 28 and is engaged and guided around the guide element 23 below the typing ribbon 17. From there it is engaged and guided around the guide element 24 and is wound again onto the take-up spool 31.

Figure 7:
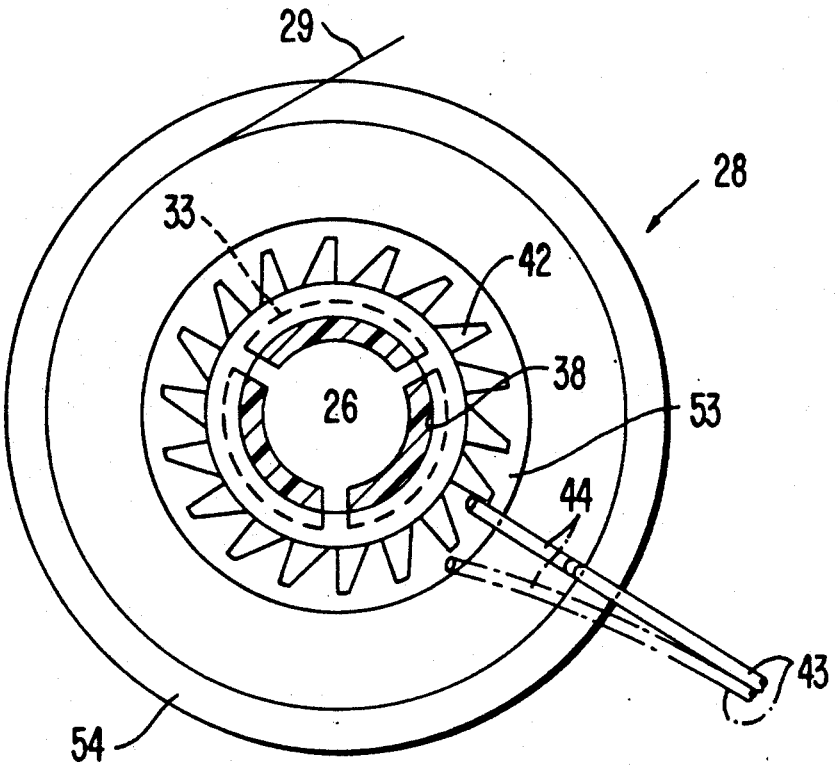
FIG. 7 is a plan view of part of the details shown in FIG. 6, on a different scale.

The cassette 11 comprises a tensioning device for the correction ribbon, which is generally indicated by reference numeral 41 and which is operative on the supply spool 28 in order always to hold the correction ribbon 29 taut. The tensioning device 41 (see FIGS. 3, 6 and 7) comprises a toothed wheel 42 which is fixed with respect to the supply spool 28 and a spring element 43 having a fixed part mounted internally of the container 16 and a flexible part having an end 44 which projects to the exterior of the container 16 by way of an aperture 46 in the bottom 21 to engage with the teeth of the toothed wheel 42 and urge the supply spool 28 in the opposite direction to unwinding of the correction ribbon 29, in order to tension the ribbon itself. In actual fact the end 44 is capable of being intermittently disengaged from the teeth of the toothed wheel 42 during the feed movement of the correction ribbon 29 and in addition is capable of always being held in engagement with one of the teeth for a given operating travel movement in which its tensioning effect is applied to the supply spool 28, as shown by way of example in FIG. 7 is continuous and dash-dotted lines.

The spring element 43 comprises a piano wire portion of which the fixed part includes an end of the wire, which is shaped as an L-shaped portion 47 accommodated in a hole 48 in the bottom 21 and an intermediate part of the wire, which is positioned between two shoulders 49 and 51 within the container 16. A lug 52 on the container, which projects over the intermediate part of the piano wire portion, between the L-shaped part 47 and the two shoulders 49 and 51, finally prevents vertical displacement thereof. The flexible part of the spring element 43 includes the end 44 of the pinao wire portion, which is shaped as a Z-shaped portion capable of permitting the end 44 to issue from the aperture 46 in the bottom 21 in order to extend out of the container 16 and come into engagement with the teeth of the toothed wheel 42 of the supply spool 28. Finally the flexible portion of the spring element has an intermediate section of the piano wire portion which is within the container 16 and which is capable of beig counteracted by a shoulder 56 in the container 16, in the rest condition, by virtue of the prestressing of the wire produced by the shoulders 49 and 51 and the hole 48.

The spring element 43 can be engaged by means of its end 44 with the teeth of the toothed wheel 42 while the intermediate section of the flexible part of the spring element is supported against the shoulder 56 of the container 16. The end 44 is alone in contact with the external surface of the teeth of the toothed wheel 42. As the unidirectional feed movement of the correction ribbon 29 begins, the spring element 43 is moved away from the shoulder 56, and the end 44 will engage the supply spool 28 and urge it in the opposite direction to the direction of feed movement of the correction ribbon 29, thereby holding the portion of ribbon guided by the guide elements 23 and 24 in a taut condition.

The supply spool 28 comprises the central core 53 having the cylindrical seat 38 and a lower flange 54 which is fixed with respect to an end of the central core 53 while the toothed wheel 42 is fixed with respect to the other end of the central core 53 and is adjacent to the bottom 21 of the container when the supply spool 28 is mounted on the cassette 11.

The cassette 11 comprises an anti-reversing device for the correction ribbon, as indicated generally at 61, which is co-operable with the take-up spool 31 to prevent reverse motion of the take-up spool 31. The anti-reversing device 61 (see FIGS. 3 and 4) comprises a finely toothed ring 62 which is fixed with respect to the take-up spool 31 and a stop tooth 63 of a spring element 64 on the bottom 21, which co-operates with the finely toothed ring 62. The spring element 64 is formed by a plate portion which is fixed with respect to the bottom 21 and which has at its free end the stop tooth 63 which, always being held against the fine teeth 62, prevents reverse movement of the take-up spool 31.

The take-up spool 31 comprises the central core 66 having the cylindrical seat 39, and an upper flange 67 and a lower flange 68 which are respectively fixed with respect to the ends of the central core 66. The finely toothed ring 62 is fixed with respect to the upper flange 67 and is adjacent to the bottom 21 when the take-up spool 31 is mounted on the cassette 11.

The cassette 11 (see FIGS. 1, 2, 3, 4, 5 and 8) is fitted into the machine by means of projections on the container 16, as indicated at 71, on support elements as indicated at 72 of the support 12, in such a way as to be capable of performing an oscillating movement about an axis of oscillation 70 which is parallel to the platen roller 13. The cassette 11 can also be connected by means of a connecting element 75 to a vertical displacement device of the machine as indicated at 73 which, in each correction cycle, moves the container 16 into different angular positions with respect to the axis 70 from a first position in which the typing ribbon 17 is positioned in front of the typing point 14 to a second position in which the correction ribbon 29 is positioned in front of the typing point 14. In addition the cassette 11 is capable of co-operating with a mechanism for producing a feed movement of the correction ribbon, as generally indicated by reference numeral 74, which, in each correction cycle, produces a unidirectional feed movement of the correction ribbon 29, as will be described hereinafter.

The feed mechanism 74 comprises a toothed ring 76 which is fixed with respect to the take-up spool 31 and a ratchet assembly 77 which is pivotally mounted on a support fixed to the carriage 6 about an axis parallel to the roller 13 and disposed between the axis 70 and the roller 13. The toothed ring 76 is fixed with respect to the lower flange 68 of the take-up spool 31 and is opposite to the finely toothed ring 62 which is fixed with respect to the upper flange 67.

Figure 9:
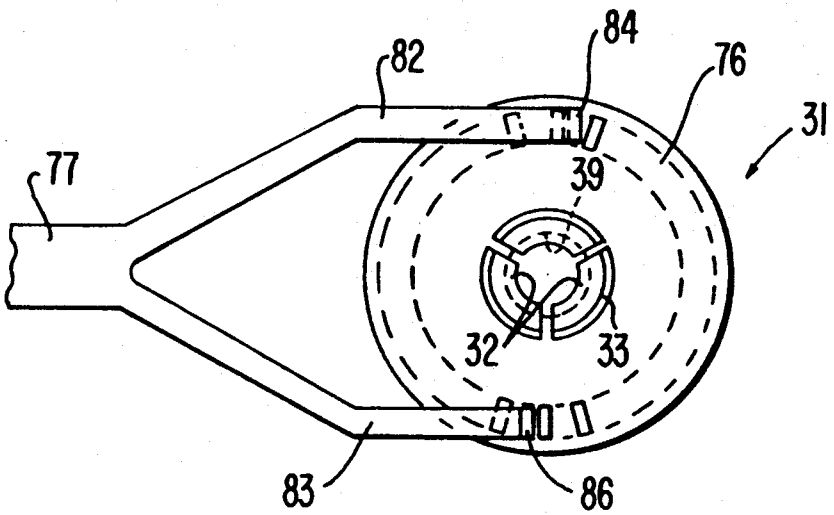
FIG. 9 is a partial view from below of some details from FIG. 1.

The ratchet assembly 77 is pivotally mounted by means of a semi-cylindrical end 79 in a seat 81 of the support 78 and comprises two arms 82 and 83 (FIG. 9) which are spaced from each other and which each have a hook portion 84, 86 co-operable with the mutually diametrally oppositely disposed teeth of the toothed ring 76. A resilient element 87, formed by a spring, holds the ratchet assembly 77 rotated in an anti-clockwise direction in such a way that in use the hook portions 84 and 86 are always in engagement with the teeth of the toothed ring 76 of the take-up spool 31 in the various positions of the container 16. The two hook portions 84 and 86 are positioned in mutually opposite directions in such a way that during a first phase for causing feed movement of the correction ribbon 29 the first hook portion 84 pulls a first tooth while the second hook portion 86 passes over a second tooth. In a second phase the first hook portion 84 passes over another tooth adjacent to the first tooth while the second hook portion 86 pushes a further tooth adjacent to the second tooth, thereby always causing the take-up spool 31 to rotate in the same direction in order in that way to produce a unidirectional feed movement of the correction ribbon 29.

The two phases for producing the feed movement of the correction ribbon 29 are effected when the vertical displacement device 73 moves the container 16 from the first position to the second position and vice-versa, causing it to oscillate about the oscillation axis 70. In fact during the displacement from the first position to the second position the spring 87 lifts the ratchet assembly 77 by causing it to rotate in an anti-clockwise direction. At the same time however by virtue of the different axes of oscillation of the container 16 and the ratchet assembly 77, there is a relative movement between the hook portions 84 and 86 and the toothed ring 76, which activates the first phase in the feed movement of the correction ribbon 29. During the displacement from the second position to the first position, the container 16, by means of the take-up spool 31, moves the ratchet assembly 77 downwardly against the force of the spring 87 and causes it to rotate in the opposite direction, thereby providing for the second phase in the feed movement of the correction ribbon 29.

The projections 71 (see FIGS. 1, 2, 3, 5 and 8) project downwardly from the bottom 21 of the container 16 and co-operate with the support elements 72 of the machine for supporting and guiding the container 16 in the movement thereof from the first position to the second position and vice-versa. For that purpose the projections 71 comprise two pivot mounting elements and two counteracting elements. In particular the projections 71 comprise two plate portions 89 and 91 which are fixed with respect to the bottom 21 and which are spaced and parallel to each other and which each have at one end a cylindrical pin 92, 93 which constitutes a pivot mounting element while at the other end they have a shoulder 94, 96 which constitutes the counteracting element of the projections 71.

The support elements 72 of the machine are fixed with respect to the support 12 which is fixed to the carriage 6, and they each comprise a plate 97, 98 which at one end has a wall which is bent in such a way as to delineate a semicylindrical groove 99 and 101 while at the other end they have a wall 102, 103. The axes of the semicylindrical grooves 99 and 101 are substantially coplanar with each other and define the axis of oscillation movement 70 of the container 16. Each groove 90, 101 is capable of accommodating and guiding the respective pin 92, 93 of the plate portion 89, 91 for an oscillating movement about the axis 70. Each groove 99, 101 is closed laterally and outwardly by a wall 142, 143, which is co-operable with an inward side of the pin 92, 93 in such a way as to define the transverse position of the container 16 with respect to the carriage 6 with precision.

At the end of each plate 97, 98 the wall 102, 103 is in the form of a sector of a cylinder, with its axis coincident with the axis of oscillation movement 70, and constitutes a stop member for the counteracting elements 94, 96 such as to prevent longitudinal displacement of the container 16 during the movement thereof between the first and second operating positions. In particular that movement corresponds to an oscillation movement of about 10° about the axis 70 from a substantially horizontal position of the container 16.

The connecting element 75 of the cassette 11 comprises a pin 107 which projects laterally from the container 16, on the side of one of the projecting arms of the container.

The vertical displacement mechanism 73 of the machine comprises a connecting lever 104 of elongate shape which is disposed vertically, with a capacity for rotary movement about one of its ends, being its lower end, for connection with the connecting element 75 of the cassette 11. The lever 104 is also capable of vertical displacement in order to effect displacement of the cassette 11. The lever 104 is guided by two walls 117 and 118 of the support 12 to be moved in a flat trajectory perpendicular to the roller 13 and the axis 70 and is disposed on the carriage 6 in an intermediate position between the axes 70 and the roller 13.

The lever 104 comprises a semicylindrical seat 106 which is co-operable with the pin 107 on the cassette 11 when the cassette is correctly fitted onto the support elements 72. For that purpose a spring 108 urges the lever 104 in an anti-clockwise direction (FIGS. 1, 2) in such a way that the seat 106 is engaged with the pin 107. The lever 104 is in turn pivotally mounted by means of its lower end by way of a seat 109 on a ball joint 111 on a control lever 112 which constitutes an output member of the vertical displacement device 73 of the machine. That device 73 in turn comprises a slot-type cam 113 fixed on a drive shaft 114 capable of bidirectional oscillatory movements on the carriage 6.

The control lever 112 is pivotally mounted on a shaft 115 which is fixed to the carriage 6, and at one end carries a cam follower pin 116 engaged with the cam 113 while at its other end it carries the ball joint 111. The cam 113, by means of the lever 112, is capable of imparting to the pin 111 a substantially vertical alternating movement which is transmitted to the connecting lever 104, as described hereinafter, for raising or lowering the container 16 between the first and second positions. When the cassette 11 is not mounted on the support 12, the connecting lever 104 is held by the force of the spring 108 against a fixed shoulder 119 on the carriage 6, in a position involving an additional travel movement with respect to the position in which it is engaged with the pin 107.

Figure 10:
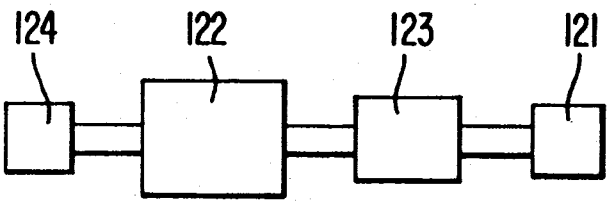
FIG. 10 is a block logic diagram of a control and governing unit of the machine shown in FIG. 1.
Figure 8:
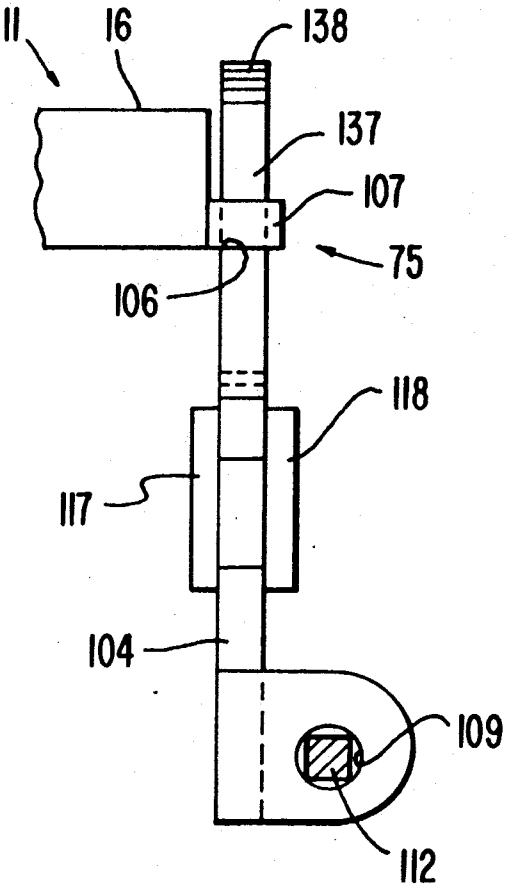
FIG. 8 is a partial front view of some details from FIG. 1.

The drive shaft 114 (see FIGS. 1, 2 and 10) is driven by an electric motor 121 controlled by a central unit 122 by way of an input-output unit 123 and a keyboard 124. The motor 121 is operable to rotate the shaft 114 in an anti-clockwise direction from a rest position to an operative position, positively lifting the lever 104. Consequently the cassette 11 which is fitted onto the support elements 72 and engaged by the lever 104 will be positively rotated about the axis 70 from the substantially horizontal position thereof. The motor 121 is then operable to rotate the shaft 114 in a clockwise direction for positive lowering movement of the lever 104 and the cassette 11 connected thereto.

The typing ribbon 17 which is accommodated in the container 16 is advanced in each typing cycle by a known type of feed arrangement and which on the machine comprises a rotatable shaft 131 guided by a support 132 on the carriage 6 and having a blade 133 engageable with a drive roller 134 of the cassette 11, which is accommodated within the container 16 and is co-operable with a pinch roller 135 for producing unidirectional feed movement of the typing ribbon 17. The blade 133 is of a length such that it always remains engaged with the drive roller 134 both in the first operating position and in the second operating position of the container 16 as shown in FIGS. 1 and 2.

With reference to FIGS. 1 to 10, the operation of fitting the various parts of the cassette 11 in the machine and the mode of operation of the parts as described herein are very simple and reliable.

To fit the supply spool 28 and the take-up spool 31 to the container 16, operation is effected in the following manner. The two spools 28 and 31 are positioned in such a way that the cylindrical seats 38 and 39 virtually correspond to the respective resilient segments 26 and 27, then a portion of the correction ribbon 29 is laid around the guide elements 23 and 24. With the spools 28 and 31 being held parallel to the bottom 21, the seats 38 and 39 are now put into positions corresponding to the resilient elements 26 and 27 and a slight pressure is applied by hand to urge the spools 28 and 31 towards the bottom 21. The bevel portions 32 assist with engagement with the inward edges of the seats 38 and 39 while the shoulders 33, engaging with the inward surfaces of the seats 38 and 39, cause the resilient segments 26 and 27 to be flexed radially, thus providing for easy fitting of the seats 38 and 39 onto the resilient segments 26 and 27.

The assembly operation will be completed when the toothed wheel 42 of the supply spool 28 and the upper flange 67 are adjacent to the bottom 21. In that position the shoulders 33 are no longer engaged with the internal surfaces of the seats 38 and 39, the resilient segments 26 and 27 spring back into their original positions and the spools 28 and 31 are fitted onto the container 16 in such a way as to be rotatably held in position by the shoulders 33. If in that phase a tooth of the toothed wheel 42 is aligned with the end 44 of the spring 43, the segments 26 cannot return to the rest condition. It will only be necessary however to ensure that the supply spool 28 is rotated a little in one of the two directions in order to position the end 44 of the spring 43 between two adjacent teeth of the toothed wheel 42, thus permitting latching engagement of the segments 26. The take-up spool 31 is then rotated by hand to tension the correction ribbon 29.

To remove the spools 28 and 31 from the container 16, operation is effected in the reverse manner to the foregoing description. A slight manual pressure is applied to the spools 28 and 31, moving them away from the bottom 21, and the resilient segments 26 and 27 flex radially when the shoulders 33 come into engagement with the internal surfaces 38 and 39, thus permitting disengagement and removal of the spools 28 and 31 from the container 16.

When the cassette 11 is removed from the machine, the lever 104 is rotated in an anti-clockwise direction to a position against the fixed stop 119 due to the force of the spring 108 and the ratchet assembly 77 of the feed mechanism 74 is in a raised position in which it bears against a fixed stop 136 on the carriage 6.

To fit the cassette 11 to the support 12 of the carriage 6, the operation is as follows. The cassette 11 is held inclined at more than 15° with respect to a horizontal plane and it is positioned with the pins 92 and 93 in the semicylindrical grooves 99 and 101, then rotating it downwardly and thus towards the carriage 6 and the roller 13. During that rotary movement the shoulders 94 and 96 come into engagement with the walls 102 and 103 and the pin 107 is engaged with an inclined surface 137 of the lever 104, thus rotating the lever 104 in the clockwise direction about the pin 111 against the force of the spring 108. At the same time the toothed ring 76 comes into engagement with the hook portions 84 and 86 of the ratchet assembly 77, rotating it in a clockwise direction against the force of the spring 87. When the pin 107 is at a position corresponding to the seat 106, the pulling force of the spring 108 causes the lever 104 to rotate abruptly, holding the seat 106 engaged with the pin 107. After that phase the pins 92 and 93 are engaged with the respective semicylindrical grooves 99 and 101 and the cassette 11 is fitted onto the support 12 of the carriage 6 in such a way that it can oscillate by means of the lever 104. On the other hand the constraints applied by the elements 72, the lever 104 and the cam 113 prevent the cassette 11 from moving, due to external causes, from the position imparted by the vertical displacement mechanism 73. In the rest position of the cassette 11 the typing ribbon 17 is positioned in its first position in front of the typing point 14.

If typing cycles are effected, the container 16 remains in the first operating position and the typing ribbon 17 performs a feed movement by virtue of the rollers 134 and 135, by means of rotary movement of the shaft 131 and the blade 133 in known manner which is not shown in the drawings.

If a correction cycle is effected, the central unit 122 produces signals such as to activate the motor 121. The latter causes rotary movement in an anti-clockwise direction through about 270° of the drive shaft 114 with the cam 113 from the position shown in FIG. 1 to the position shown in FIG. 2. The control lever 112, which rotates on the shaft 115, raises the connecting lever 104 and moves the container 16 from the first position to the second position, bringing the correction ribbon 29 in front of the typing point 14. During that upward displacement of the container 16, the spring 87 causes the ratchet assembly 77 to be rotated in the anti-clockwise direction, lifting it and actuating the first phase of feed movement of the correction ribbon 29 in which the hook portion 84 pulls the respective tooth of the toothed ring 76 while the hook portion 86 passes over the respective tooth for a feed movement of the correction ribbon equal to the first half of the amount allotted to each character, followed then by the cancellation operation by means of the striker hammer 8 and the character carrying disc 7.

After that the central unit 122 outputs further signals such as to activate the motor 121 to cause the drive shaft 114 with the cam 113 to rotate in the clockwise direction through about 270°. The control lever 112 is rotated in the clockwise direction and moves the connecting lever 104 downwardly, moving the container 16 from the second position to the first position, thereby moving the typing ribbon 17 back into a position in front of the typing point 14. During that downward displacement of the container 16, by means of the take-up spool 31, the ratchet assembly 77 is rotated in the clockwise direction, being moved downwardly against the force of the spring 87 and thus actuating the second phase in the feed movement of the correction ribbon 29 in which the hook portion 84 passes over the respective tooth while the hook portion 86 pushes the respective tooth, rotating the take-up bobbin 31 in the same direction as the rotary movement effected in the first phase and thus causing a unidirectional feed movement of the correction ribbon 29.

For the purposes of removing the cassette 11 from the support 12, the operation is as follows.

The lever 104 is rotated by hand in a clockwise direction, by engaging a knurled surface 138 thereof, adjacent to the inclined surface 137, against the force of the spring 108 until the pin 107 is disengaged from the seat 106. The container 16 is then rotated in an anti-clockwise direction through more than 15°, lifting the arms 18 and 19 with respect to the platen roller 13 and the carriage 6 until the positioning shoulders 94 and 96 are disengaged from the respective walls 102 and 103. The pins 92 and 93 are then extracted from the respective seats 99 and 101 by displacing the cassette 11 towards the platen roller 13. The cassette 11 is thus removed from the support 12 on the carriage 6. The connecting lever 104 which is now liberated is rotated by the spring 108 until it is stopped against the shoulder 119 of the support 12 while, during the rotary movement of the container 16, the spring 87 had caused the ratchet assembly 77 to rotate in the anti-clockwise direction until it came to bear against the fixed stop 136.

It will be appreciated that modifications may be made in the cassette 11 with the coupling means 22, the guide elements 23 and 24, the supply spool 28 and the take-up spool 31, the tensioning device 41 and the reverse device 61, the projections 71 and the connecting element 75, both in regard to the form and the arrangement of the various components, without departing from the scope of the present invention.

What I claim is:

1. A unitary typing and correction cassette for a typing machine or the type comprising a platen roller having a typing point, and a carriage movable parallel to the platen, said carriage having support means for pivotally supporting the cassette, a ribbon feed mechanism for feeding a typing ribbon of the cassette, a lifting device for the cassette, and a hooked lever for feeding a correction ribbon in response the lifting of the cassette, wherein said support means comprise two pivot seats spaced apart from each other parallel to the platen, wherein said ribbon feed mechanism comprises a feed shaft having a connection member positioned between the pivot seats and the platen and wherein said lifting means comprises a lifting lever having a seat also positioned between the pivot seats and the platen for providing a vertical reciprocatory movement, said unitary cassette comprising:

a container for accommodating a typing ribbon, having a bottom wall and two projecting arms, wherein said arms have guide ends for positioning an external portion of the typing ribbon in front of the typing point;

a feed roller and a pinch roller rotatably supported by said container and engaging the typing ribbon, wherein said feed roller is engageable with said connection member of the feed shaft for producing unidirectional feed of the typing ribbon;

two members projecting downwardly from said bottom wall and having respective lateral pivot projections, wherein said pivot projections are engageable with the pivot seats of said support for oscillatory movement of said cassette about an axis of oscillation parallel to the platen;

a pin projecting laterally from one of said arms and engageable with the seat of said lifting lever for actuating said oscillatory movement of the cassette in response to the reciprocatory movement of said lifting lever; and a correction portion with a correcting ribbon attached downwardly to said bottom wall, said correction portion comprising:

a supply spool and a take up spool for the correction ribbon rotatably supported by two respective coupling members projecting downwardly from said arms, wherein said coupling members comprise a plurality of flexible tongues with bevel surface of manual snap fitting and removal of said spools;

two guide elements projecting downwardly from said guide ends for guiding a portion of said correction ribbon below the external portion of the typing ribbon in parallel relationship to the platen; and a toothed ring on said take up spool, wherein said hooked lever has two hook portions cooperative with oppositely disposed teeth of said ring upon engagement of said pivot projections with said pivot seats and said lever seat with said pin for advancing the correcting ribbon upon the oscillatory movement of said cassette.

2. A cassette according to claim 1, wherein each supply spool and take-up spool comprises a control core having a cylindrical seat, and each of said two coupling members comprises a main cylindrical body which is subdivided into three resilient segments disposed at 120 degrees relative to each other for rotatably supporting respective cylindrical seats of said supply spool and said take-up spool, and wherein said three resilient segments are radially flexible and have at their free ends bevel means for assisting fitting of one of said control cores onto said main cylindrical body, and wherein shoulder surfaces are adjacent said bevel means and project radially to prevent accidental disengagement of the respective spools from said three resilient segments.

3. A cassette according to claim 1, wherein said two guide elements are fixed with respect to said bottom opposite to said ends and each comprises a shaped central plate portion having at its ends two shoulders for guiding and preventing vertical displacements of said correction ribbon.

4. A cassette according to claim 1, further comprising a tensioning device cooperable with said supply spool for holding said correction ribbon in a taut condition wherein said tensioning device comprises a toothed wheel fixed to said supply spool and positioned adjacent an external edge, and a spring element for cooperating with the teeth of said toothed wheel and for urging the supply spool in an opposite direction to the feed movement of said correction ribbon, and wherein said ends are selectively cooperative with said teeth during the advancement of said correction ribbon.

5. A cassette according to claim 1, wherein the container comprising and anti-reversing device cooperable with said take-up spool to prevent reverse movement of said take-up spool, wherein said anti-reversing device comprises a spring element of the bottom having a stop tooth and a finely toothed ring which is fixed with respect to said take-up spool and cooperable with said stop tooth of the spring element.

6. A cassette according to claim 5, wherein said spring element comprises a plate portion which is fixed with respect to said bottom and has at its free end said stop tooth which is held against the fine teeth of the finely toothed ring.

7. A cassette according to claim 6, wherein said take-up spool comprises a central core, an upper flange which is fixed with respect to an end of said central core and a lower flange which is fixed with respect to another end of said central core, wherein said finely toothed ring is fixed with respect to said upper flange and is adjacent said bottom.

8. A cassette according to claim 7, for a typing machine, wherein a resilient element urges said hooked lever against said toothed ring such that the respective hook portions are always in engagement with the teeth of said toothed ring, wherein said hooked lever has two arms provided with said hook portions and wherein said two arms are spaced from each other such that the respective hook portions are engaged with two mutually diametrically oppositely disposed teeth of said toothed ring.

9. A cassette according to claim 8, for a typing machine wherein said two hook portions are positioned in mutually opposite directions such that during a first phase for producing a feed movement of the correction ribbon a first hook portion pulls a first tooth while a second hook portion passes over a second tooth and in a second phase for producing a feed movement of the correction ribbon the first hook portion passes over another tooth adjacent said first tooth while the second hook portion pushes a further tooth adjacent the second tooth thereby always causing said take-up spool to rotate in the same direction.

10. A cassette according to claim 1, for a typing machine wherein said pivot seats comprise two respective grooves spaced from each other and which define said axis of oscillation movement parallel to the platen roller, and two top members positioned between said grooves and said platen roller and in front of said grooves, wherein said projecting members of the cassette further comprise two counteracting elements, wherein said projecting members are inserted between said grooves and said stop members such that said pivot projections are pivotally disposed in said grooves for oscillating movement about said axis and wherein said counteracting elements are opposed by said stop members for positive control of a given oscillatory travel movement of said container which is determined by said connecting lever.

11. A cassette according to claim 10 for a typing machine, wherein said lifting device comprises an output member actuated with a substantially vertical alternating movement and wherein the lifting lever is positioned between said axis and said platen roller and has a first lower portion pivotally connected to said output member and a second upper portion having a seat, wherein spring means are provided for urging said seat towards the axis, wherein said lifting lever is freed from said seat in response to a manual movement of said lifting lever in opposition to the tension of said spring means, and wherein said counteracting elements are freed from the respective stop members after the freeing of said connecting element and inclination of said container through a distance greater than said oscillating travel movements.

12. A cassette according to claim 10, wherein said projecting members comprise two plates which project from said bottom wall and are spaced from and parallel to each other, wherein each plate and each counteracting element comprises a shoulder for positioning of the plate, wherein said support members of the typing machine comprise two plate portions each having at one end an L-shaped bent portion which defines said groove which is of semicylindrical internal section for accommodating and guiding said cylindrical pin of the cassette, wherein each of said two plate portions define at the other end a curved wall in which the center of curvature coincides with said axis and defines said stop member, and wherein said curved wall is cooperative with said shoulder to prevent longitudinal displacements of said container during movement from a first operating position in which said typing ribbon is in front of the typing point to a second operating position in which said correction ribbon is in front of the typing point and vice-versa.

13. A unitary typing and correction cassette for a typing machine of the type comprising a platen roller having a typing point, and a carriage movable parallel to the platen, said carriage having support means for pivotally supporting the cassette, a ribbon feed mechanism for feeding a typing ribbon of the cassette, a lifting means for the cassette, and a hooked lever for feeding a correction ribbon in response to the lifting of the cassette, said hooked lever includes a lever seat and a pivot, wherein said ribbon feed mechanism comprises a feed shaft having a connection support member and wherein said lifting means comprises a lifting member providing a reciprocatory movement, said unitary cassette comprising:

a container for accommodating said typing ribbon having a bottom wall and two projecting arms, wherein said arms have guide ends for positioning an external portion of the typing ribbon in front of the typing point;

a feed roller and a pinch roller rotatably supported by said container and engaging the typing ribbon, wherein said feed roller is engageable with said connection member for producing unidirectional feed of the typing ribbon;

pivot means including pivot projections and pivot seats engageable with said support means for an oscillatory movement of said cassette about an axis of oscillation parallel to the platen;

connecting means cooperative with said lifting member for actuating said oscillatory movement of the cassette in response to the reciprocatory movement of said lifting member; and a correction portion with a correcting ribbon attached downwardly to said bottom wall, said correction portion comprising:

a supply spool and a take-up spool for the correction ribbon rotatably supported by two respective coupling members projecting downwardly from said arms, wherein said coupling members comprise a plurality of flexible tongues with shoulder surfaces for manual snap fitting and removal of said spools;

two guide elements projecting downwardly from said guide ends for guiding a portion of said correction ribbon below the external portion of the typing ribbon in parallel relationship to the platen;

a first toothed wheel fixed to said supply spool and a second toothed wheel fixed to said take-up spool, wherein said first and second toothed wheels are adjacent said bottom wall;

a tensioning and anti-reversing device for said correcting ribbon comprising a first wire spring cooperative with said first toothed wheel and a second wire spring cooperative with said second toothed wheels; and a toothed ring fixed to said take-up spool spaced apart from said bottom wall, wherein said hooked lever has two hook portions cooperative with oppositely disposed teeth of said ring upon engagement of said pivot projections with said pivot seats and said lever seat with pin for advancing the correcting ribbon upon the oscillatory movement of said cassette; and wherein said first wire spring and said second wire spring each comprise an end engageable and releasable with respect to said first toothed wheel and said second toothed wheel upon fitting and removal of said supply spool and said take-up spool, respectively.

14. A cassette according to claim 13, wherein the bottom wall comprises an internal edge, an external edge and an aperture positioned adjacent said supply spool and wherein said first wire spring and said second wire spring each have a fixed part mounted internally of said container adjacent the internal edge and a flexible part having an end which projects from said aperture.

15. A cassette according to claim 14, wherein each of said wire springs moves the fixed part and an intermediate part positioned adjacent the internal edge and wherein said flexible part extends out of said container through said aperture.

16. A cassette according to claim 15, wherein said fixed part comprises an end having an L-shaped part accommodated in a hole in said bottom and said flexible part comprises another end which is positioned between two fixed shoulders on the container, wherein a lug of the container is positioned to project over the fixed part in an intermediate position between the L-shaped portion and the two shoulders to prevent vertical displacement of said fixed part, and wherein the container comprises a shoulder and the flexible part has an intermediate section which is counteracted by said shoulder by virtue of the prestressing of the wire portion produced by the shoulders and the hole.

17. A cassette according to claim 15, wherein said flexible part has a Z-shaped portion positioned in said aperture and wherein said end comes into engagement with the teeth of said toothed wheel of said supply spool.

18. A cassette according to claim 14, wherein said supply spool comprises a central core, a lower flange which is fixed with respect to an end of said central core and said toothed wheel which is fixed with respect to another end of said central core and is adjacent said bottom.

* * * * *